US005775235A

United States Patent [19]

Lindskog et al.

[11] Patent Number: 5,775,235

[45] Date of Patent: Jul. 7, 1998

[54] METHOD AND DEVICE FOR DESTRUCTION OF OBJECTS

[76] Inventors: Kjell Lindskog, Foravägen 27, S-931 39 Skellefteå; Ola Fristrom, Anumark 84, S-905 95 Umeå, both of Sweden

[21] Appl. No.: 732,741

[22] Filed: Oct. 18, 1996

Related U.S. Application Data

[63] Continuation-in-part of PCT/SE95/00418, Apr. 18, 1995.

[30] Foreign Application Priority Data

Apr. 19, 1994 [SE] Sweden ..... 9401340

[51] Int. Cl.[6] ..... E05G 1/00

[52] U.S. Cl. ..... 109/25; 109/31; 109/32; 109/37

[58] Field of Search ..... 109/31–34, 36, 109/25, 29–30, 37, 20

[56] References Cited

U.S. PATENT DOCUMENTS

| | | | |
|---|---|---|---|
| 3,676,945 | 7/1972 | Neanhouse | 109/33 |
| 4,025,369 | 5/1977 | Price et al. | 109/36 |
| 4,236,463 | 12/1980 | Westcott | 109/33 |
| 4,607,579 | 8/1986 | Stenild | 109/33 |
| 4,712,489 | 12/1987 | Levavasseur . | |
| 4,853,676 | 8/1989 | Kitts | 109/33 |
| 5,196,828 | 3/1993 | Keniston | 109/31 |

FOREIGN PATENT DOCUMENTS

| | | | |
|---|---|---|---|
| 0165915 | 2/1993 | Denmark . | |
| 8303872 | 11/1983 | WIPO . | |
| 9117681 | 11/1991 | WIPO | 109/36 |

*Primary Examiner*—Darnell M. Boucher
*Attorney, Agent, or Firm*—Nils H. Ljungman and Associates

[57] ABSTRACT

A method of destroying an object(s) stored in an alarm-protected safety enclosure, there being a destructive agent which is distributed over the object(s) when an alarm is triggered. The destructive agent marks and/or destroys the object(s) within the safety enclosure. A first explosive substance and a second explosive substance are used to shred the object(s) and to distribute the destructive agent over the object(s). The first explosive substance may be triggered by the alarm prior to the second explosive substance. The triggered first explosive substance shredding the object(s) and the triggered second explosive substance distributing the destructive agent over the object(s).

20 Claims, 2 Drawing Sheets

FIG. 1
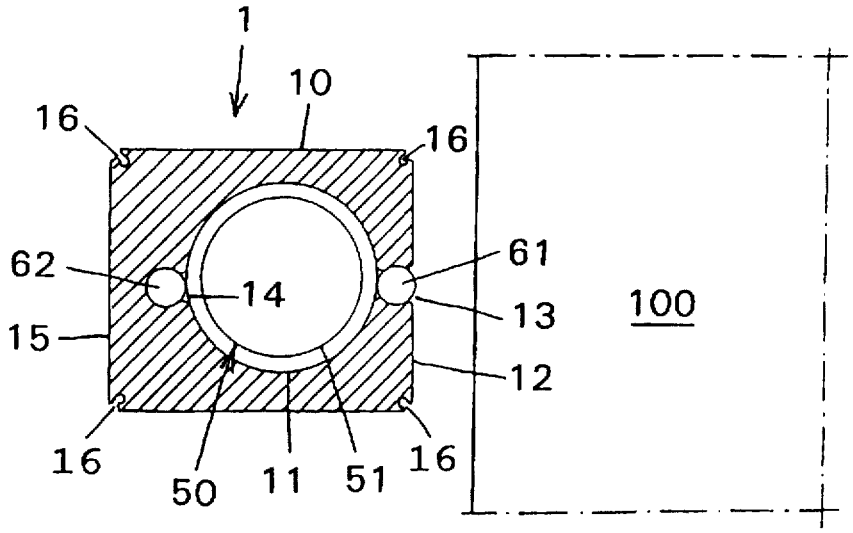
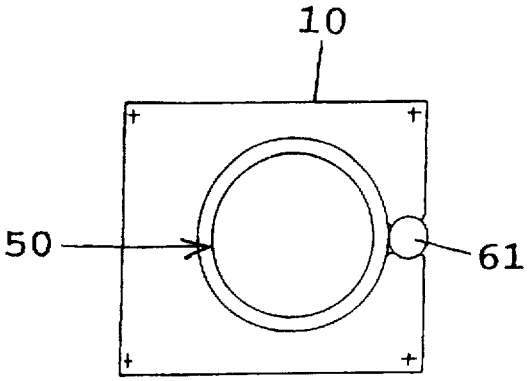
FIG. 2

FIG. 3
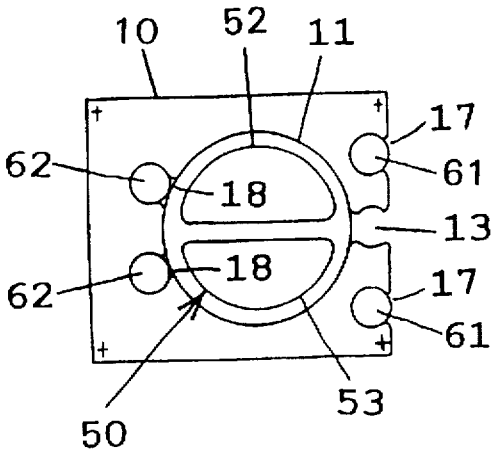
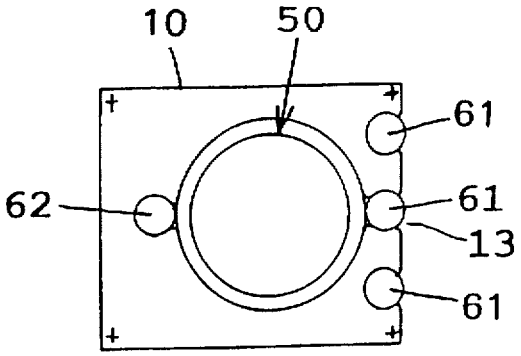
FIG. 4
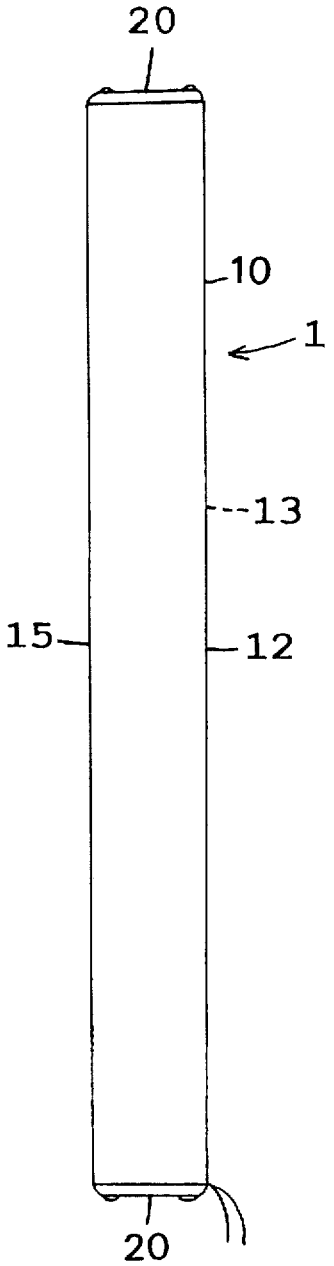
FIG. 5

METHOD AND DEVICE FOR DESTRUCTION OF OBJECTS

The present invention relates to a method of destroying objects or products stored in an alarm-protected safety enclosure, there being used a destructive agent which when an alarm is triggered is distributed over the product or products and therewith mark and/or destroy the same. The invention also relates to a device for carrying out the method.

Safety containers for the transportation of valuable objects, such as banknotes for instance, normally include a destructive agent in the form of ink cartridges or ink ampules which are activated in the event of unauthorized manipulation of the container, so as to deface or destroy the contents of the container.

When the contents of the container are in the form of a number of sealed, plastic-wrapped products, such as bundles of plastic-wrapped banknotes tor instance, it is extremely difficult to achieve satisfactory defacement or destruction of the wrapped and sealed products.

WO 92/07159 teaches a destructive device in which ink-defacement of valuable products contained in a safety enclosure is improved with the aid of an explosive device. However, the destructive efficiency of this arrangement has been found wanting in practice, since certain parts of the products sometimes remain undamaged and can be used by the thief, contrary to intentions.

The object of the present invention is to provide a method and a device which, when necessary, will destroy effectively products that are contained in a safety enclosure. This object is achieved with a method and a device having the characteristic features set forth in the following claims.

The following advantages are among those afforded by the invention.

For instance, in accordance with the invention, there is generated a primary shockwave which will split or flakeup the wrapping and/or the bundled banknotes or other products, so as to expose for coaction with the destructive agent a much larger surface area than that exposed with earlier known devices in this respect.

The destructive efficiency of the invention is further enhanced by coaction between a first and a second explosive substance.

The inventive device takes-up only a small amount of space and is of simple design and construction, and can be used together with varying explosive compositions and provides many alternatives with regard to the positioning of the explosive or explosives. The device will operate with both single-component and multicomponent destructive agents of different types, and also different agents for destroying magnetic tapes, diskettes and other information carriers. The inventive device can be readily produced in desired lengths and can be adapted to desired recuirement specifications.

The inventive device affords both technical and economical advantages.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

The invention will now be described in more detail with reference to exemplifying embodiments thereof and also with reference to the accompanying drawings, in which FIG. 3. is a schematic cross-sectional view of a first embodiment of an inventive destructive device; FIGS. 2–4 are schematic cross-sectional views of alternative embodiments of the inventive destructive device; and FIG. 5 is a schematic view of the destructive device from above.

The destrucLive device 1 illustrated in FIG. 1 includes a casing in the form of, for instance, from an aluminium extruded profile 10. The housing/profile 10 includes a cavity 11 which extends along the full length of the profile and accommodates a destructive agent 50. The front side 12 of the profile 10 includes a groove or recess 13 which accommodates a first explosive string 61. When the destructive device 1 is in use, the front side 12 of the profile or housing is intended to face towards the product or products 100 to be destroyed upon unauthorized manipulation of the container. The groove or recess 13 preferably extends along the whole of the profile 10.

The destructive device 1 of the FIG. 1 embodiment also includes a groove 14 or a recess 14 for accommodating a second explosive string 62. The recess 14 extends along the whole of the profile 10 and is located in a region of the cavity 11 that faces towards the rear side 15 of the profile 10.

The profile 10 has provided at its corners so-called screw pockets/screw grooves 16 which enable two end plates 20 to be readily screwed to the profile 10, so as to cover both ends thereof.

The destructive device 1 illustrated in Figs. 1 and 5 also includes a destructive agent 50, which may be any one of many different kinds. For instance, the destructive agent 50 may be a single-component heavily staining liquid or ink encapsulated, for instance, in a thin-wall plastic hose 51 which is sealed at both ends thereof, the length of the closed plastic hose 51 coinciding essentially with the length of the profile 10, so that the cavity 11 will be adequately filled. The destructive agent 50 may alternatively comprise a two-component liquid, for instance two-component polyurethane, wherein the different liquid components for instance are each encapsulated in a respective thin-wall plastic-foil hose 52, 53 which is sealed at both ends thereof. The closed plastic hoses 52, 53 share the cavity 11 and together extend essentially along the full length of the cavity 11, as exemplified in FIG. 3.

It will be understood that the destructive agent may be comprised of many different types of chemicals or substances, and that the destructive agent may be in powder form as an alternative to a liquid form. The plastic-foil hoses may sometimes be omitted, provided that the cavity 11 is effectively sealed in some efficient manner.

The first explosive substance 61 of the FIG. 1 embodiment may have the form of a cordtex or pentyl string, which may optionally be encased in plastic and which extends along the full length of the groove 13. The second explosive substance 62 may also have the form of a cordtex string or a pentyl string and optionally encased in plastic and extend along the full length of the groove 14 .

The explosive substances 61 and 62 are connected in an electrical alarm circuit incorporated in the safety enclosure or container and are preferably connected so that the first explosive substance 61 will be triggered shortly before the second explosive substance 62, for instance with a time lapse of 1 μs. The first explosive substance 61 and, when applicable, also the second explosive substance 62 will conveniently include means, for instance an electrically conductive wire, which will detect, e.g. through measurement of resistance, any function disturbing breakage of the explosive strings.

FIGS. 2–4 illustrate by way of example different alternatives in the positioning of the explosive strings.

The destructive device illustrated in FIG. 2 uses only the aforesaid first explosive string 61.

On the other hand, the destructive device illustrated in FIG. 3 uses two first explosive strings 61, which in this case have been placed in grooves 17 on respective sides of the opening/groove 13, and two second explosive strings 62 placed in respective grooves 18 in the rear wall of the cavity 11.

In the embodiment illustrated in FIG. 4, the destructive device includes three first explosive strings 61, of which one is placed in the outlet groove 13, and one second explosive string 62 which is placed in the rear wall of the cavity 11.

It will be understood that many alternative combinations are possible with regard to the positioning of the explosives 61 and 62.

The working end the use of the destructive device will now be explained more specifically.

It is assumed that the destructive device 1 is placed in an alarm-protected safety container, with the first explosive substance 61 and, when applicable, the second explosive substance 62 connected to the alarm arrangement of the safety container. The length of the destructive device 1 will preferably be the maximum permitted by the container, and the destructive device is placed as close as possible to the products or objects 100 to be destroyed upon unauthorized manipulation of the container, wherewith the front side 12 of the destructive device is directed towards the products 100, which may, for instance, have the form of plastic-wrapped, sealed bundles of banknotes.

The following events occur when the destructive device 1 is activated/triggered by the alarm arrangement.

The first explosive substance 61 acts at least partially on the product/products 100 before the product/products is/are acted upon by the destructive agent 50 accommodated in the destructive device. It will be understood that the first explosive substance 61 propagates freely in a direction towards the product/products 100. It will also be understood that the device will always include at least one explosive charge which acts at least partially outwards against the product/products 100 and therewith open the wrapping material and shred or flake-up the valuable products while increasing the surface area available to the destructive agent. The inventive Drocedure ensures that the valuable products are acted upon by the explosive forces before the destructive agent has time to reach the products.

The groove 13 functions as an outlet zone for the destructive agent 50.

In the case of the destructive device illustrated in FIG. 1, the first explosive substance 61 will act outwardly against the products 100 and also inwardly against the destructive agent 50. The second explosive substance 62 acts against the destructive agent 50 so as to puncture or rupture the capsule of the desctruction agent and propels the agent through the outlet zone 13 and onto the already damaged products 100. Coaction between the first explosive substance 61 and the second explosive substance 62 is most effective when the first explosive substance is exploded shortly before the second explosive substance, for instance with an intermediate time span of 1 μs. It will be understood, however, that the first and the second explosive substances 61 and 62 may be exploded simultaneously.

In the case of the FIG. 2 embodiment, the first explosive substance 61 is effected in disintegrating or splitting-up the valuable products 100 as well as in propelling the destructive agent 50.

In the case of the FIG. 3 embodiment, the first explosive substances 61 are effected in disintegrating or splitting-up the valuable products 100 and the second explosive substances are effective in propelling the desctuctive agent 50.

In the case of the FIG. 4 embodiment, the first explosive substances 61 are effective in disintegrating or splitting-up the valuable products, while the destructive agent is distributed by virtue of coaction between the first explosive substance 61 placed in the outlet zone 13 and the second explosive substance 62.

When the destructive agent is comprised of more than one component, these components will be mixed effectively by the explosive substances prior to leaving the destructive device through the outlet slot 13.

It will be noted that the first and the second explosive substances can be triggered simultaneously when their mutual positions are such that the first explosive substance will act on the products 100 before the second explosive substance acts thereon. Otherwise, the earlier mentioned time lapse between detonations is highly important.

It will be understood that the aforesaid pentyl explosive charge can be substituted for an equivalent explosive of some other kind.

The second explosive substance 62 may also be placed directly in the space or cavity 11, if so desired. For instance, the second explosive charge may have the form of an explosive powder coated on the inner wall surface of the cavity 11. Alternatively, the second explosive charge may have the form of a string of pentyl explosive placed directly in the cavity 11.

It will be understood that many variations are possible with regard to the combinations between the first explosive substances and the second explosive substances.

The invention is therefore not restricted to the illustrated and described embodiments thereof, since changes and modifications are conceivable within the scope of the following Claims.

One feature of the invention resides broadly in the method of destroying a product or products stored in an alarm-protected safety enclosure, there being used a destructive agent (50) which is distributed over the object or objects (100) when the alarm is triggered, so as to mark and/or destroy said product or products, characterized by using a destructive device (1) which includes at least one first explosive substance (61) which when the alarm is triggered will act at least partially on the product/products (100) prior to said product/products being contacted by the destructive agent (50) carried by the destructive device.

Another feature of the invention resides broadly in the method characterized by causing the first explosive substance (61) and/or a second explosive substance (62) in the destructive device (1) to act on the destructive agent (50) when the alarm is triggered, so as to distribute the destructive agent over the product/products (100).

Yet another feature of the invention resides broadly in the method characterized by causing the first explosive substance (61) to be activated/triggered prior to the second explosive substance (62).

Still another feature of the invention resides broadly in the method characterized by positioning the first explosive substance (61) generally in a region between the product/products (100) and the destructive agent (50).

A further feature of the invention resides broadly in the method characterized by locating the destructive agent (50) generally in a region between the product/products (100) and the second explosive substance (62).

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign and international patent publication applications, namely, Swedish Patent Application No. 9401340-6, filed on Apr. 19, 1994, having inventors Kjell LINDSKOG and Ola FRISTRÖM, and International Patent Application PCT/SE95/00418 filed on Apr. 18, 1995, and having International Publication No. W095/28542 published on Oct. 26, 1995, and the corresponding Swedish Laid Open Patent Application and the corresponding Swedish Patent, are hereby incorporated by reference as if set forth in their entirety herein.

U.S. Pat. No. 4,712,489 which issued on Dec. 15, 1987, Denmark Patent Publication No. 165915 which published on Feb. 8, 1993 and International Publication No. 8303872 which published on Nov. 10, 1983, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

We claim:

1. A method of destroying a product stored in an alarm-protected safety enclosure, said method of destroying a product comprising:

positioning a destructive device next to the product stored in the alarm-protected safety enclosure;

activating an alarm upon an unauthorized manipulation of the alarm-protected safety enclosure;

the destructive device comprising at least one first explosive substance;

triggering the at least one first explosive substance in response to activating the alarm;

shredding the product stored in the alarm-protected safety enclosure as a result of triggering the at least one first explosive substance;

the destructive device comprising a second explosive substance;

triggering the second explosive substance in response to activating the alarm;

the destructive device comprising a destructive agent;

distributing the destructive agent over the product stored in the alarm-protected safety enclosure as a result of triggering the second explosive substance;

said step of distributing the destructive agent further comprising at least one of marking and destroying the product stored in the alarm-protected safety enclosure; and said step of distributing the destructive agent occurring subsequent to said step of shredding the product stored in the alarm-protected safety enclosure.

2. The method of destroying a product according to claim 1, wherein said step of triggering the at least one first explosive substance occurs prior to said step of triggering the second explosive substance.

3. The method of destroying a product according to claim 2, further comprising the step of positioning the at least one first explosive substance between the product stored in the alarm-protected safety enclosure and the destructive agent.

4. The method of destroying a product according to claim 3, further comprising the step of positioning the destructive agent between the product stored in the alarm-protected safety enclosure and the second explosive substance.

5. The method of destroying a product according to claim 4, wherein:

said step of triggering the at least one first explosive substance occurs about one microsecond prior to said step of triggering the second explosive substance;

the at least one first explosive substance comprises one first explosive substance;

the destructive device comprises an opening between the destructive agent and the product stored in the alarm-protected safety enclosure; and said step of positioning the at least one first explosive substance further comprises positioning the one first explosive substance in the opening.

6. The method of destroying a product according to claim 4, wherein:

said step of triggering the at least one first explosive substance occurs about one microsecond prior to said step of triggering the second explosive substance;

the at least one first explosive substance comprises a plurality of first explosive substances;

the destructive device comprises an opening between the destructive agent and the product stored in the alarm-protected safety enclosure;

the destructive device comprises at least one groove disposed near the opening in the destructive device; and said step of positioning the at least one first explosive substance further comprises positioning each of the plurality of first explosive substances in at least one of the opening and the at least one groove.

7. A destructive device to destroy a product stored in an alarm-protected safety enclosure, said destructive device comprising:

a housing;

said housing comprising a first side and a second side;

said first side of said housing to be disposed next to the product stored the an alarm-protected safety enclosure;

said first side of said housing comprising an opening;

said second side of said housing being disposed opposite to said first side of said housing;

at least one first explosive substance;

said at least one first explosive substance being disposed in said housing;

said at least one first explosive substance being disposed on said first side of said housing.;

a second explosive substance;

said second explosive substance being disposed in said housing;

a destructive agent to at least one of mark and destroy the product stored in the alarm-protected safety enclosure;

said destructive agent being disposed between said opening in said first side of said housing and said second explosive substance;

said destructive agent comprising means for being distributed over the product stored in the alarm-protected safety enclosure upon the alarm in the alarm-protected safety enclosure being activated;

said first explosive substance comprising means for at least partially shredding the product stored in the alarm-protected safety enclosure and said second explosive substance comprising means for distributing said destructive agent over the product stored in the alarm-protected safety enclosure subsequent to said first explosive substance at least partially shredding the product stored in the alarm-protected safety enclosure.

8. The destructive device according to claim 7, wherein:

said housing has a longitudinal axis;

said housing comprises a cavity;

said cavity is configured and disposed to extend in said housing substantially parallel to the longitudinal axis;

said destructive agent is disposed in said cavity;

said opening in said first side of said housing is configured and disposed to extend substantially parallel to the longitudinal axis; and said opening in said first side of said housing is operatively connected to said cavity to permit passage of said destructive agent from said cavity through said opening in said first side of said housing to the product stored in the alarm-protected safety enclosure.

9. The destructive device according to claim 8, wherein:

said at least one first explosive substance is configured to be connected to an alarm circuit;

said second explosive substance is configured to be connected to an alarm circuit; and said second explosive substance is configured to be triggered subsequent to said at least one first explosive substance.

10. The destructive device according to claim 9, wherein:

said at least one first explosive substance comprises a pentyl explosive; and said second explosive substance comprises a pentyl explosive.

11. The destructive device according to claim 10, wherein:

said at least one first explosive substance comprises a structure to detect breakages in said at least one first explosive substance; and said second explosive substance comprises a structure to detect breakages in said second explosive substance.

12. The destructive device according to claim 11, wherein said destructive agent comprises a single component liquid.

13. The destructive device according to claim 11, wherein:

said destructive agent comprises a two-component liquid; and said two-component liquid is configured and disposed to permit component liquids of said two-component liquid to be separated from one another.

14. The destructive device according to claim 13, wherein said at least one first explosive substance comprises a plurality of first explosive substances.

15. The destructive device according to claim 14, wherein:

said first side of said housing comprises a plurality of grooves;

said plurality of grooves are configured and disposed to extend on said first side of said housing substantially parallel to the longitudinal axis; and each of said plurality of grooves is disposed substantially parallel to said opening in said first side of said housing.

16. The destructive device according to claim 15, wherein one of said plurality of first explosive substances is disposed in a corresponding one of said plurality of grooves.

17. The destructive device according to claim 16, wherein one of said plurality of first explosive substances is disposed in said opening in said first side of said housing.

18. The destructive device according to claim 17, wherein said housing comprises an extruded profile.

19. The destructive device according to claim 18, wherein:

said extruded profile comprises a first end and a second end;

said first end of said extruded profile is disposed opposite to said second end of said extruded profile;

said housing comprises a first wall portion and a second wall portion;

said first wall portion of said housing is configured and disposed to seal said first end of said extruded profile; and said second wall portion of said housing is configured and disposed to seal said second end of said extruded profile.

20. The destructive device according to claim 13 wherein:

said housing comprises an extruded profile;

said extruded profile comprises a first end and a second end;

said first end of said extruded profile is disposed opposite to said second end of said extruded profile;

said housing comprises a first wall portion and a second wall portion;

said first wall portion of said housing is configured and disposed to seal said first end of said extruded profile;

said second wall portion of said housing is configured and disposed to seal said second end of said extruded profile;

said at least one first explosive substance comprises one explosive substance; and said one explosive substance is disposed in said opening in said first side of said housing.

* * * * *

UNITED STATES PATENT AND TRADEMARK OFFICE

CERTIFICATE OF CORRECTION

PATENT NO. : 5,775,235

DATED : July 7, 1998

INVENTOR(S) : Kjell LINDSKOG and Ola FRISTROM

It is certified that error appears in the above-identified patent and that said Letters Patent is hereby corrected as shown below:

In column 1, line 19, after 'banknotes', delete "tor" and insert --for--.

In column 1, line 54, after 'desired', delete "recuirement" and insert --requirement--.

In column 2, line 8, before 'is', delete "3." and insert --1--.

In column 3, line 24, after 'working', delete "end" and insert --and--.

In column 3, line 51, before 'ensures', delete "Drocedure" and insert --procedure--.

Signed and Sealed this

Second Day of March, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,775,235

DATED : July 7, 1998

INVENTOR(S) : Kjell Lindskog, et. al.

It is certified that error appears in the above-identified patent and that said Letters Patent is hereby corrected as shown below:

In column 1, after the title, insert the following:

--CONTINUING APPLICATION DATA

This application is a Continuation-In-Part application of International Application No. PCT/SE95/00418, filed on April 18, 1995, which claims priority from Swedish Application No. 9401340-6, filed on April 19, 1994.

Signed and Sealed this

Twenty-fourth Day of August, 1999

*Attest:*

Q. TODD DICKINSON

*Attesting Officer*

*Acting Commissioner of Patents and Trademarks*